United States Patent [19]

Kawabata

[11] 3,941,592

[45] Mar. 2, 1976

[54] ELECTROPHOTOGRAPHIC METHOD OF TRANSFERRING TONER IMAGE

[75] Inventor: Hidetoshi Kawabata, Tondabayashi, Japan

[73] Assignee: Minolta Camera Kabushiki Kaisha, Osaka, Japan

[22] Filed: Aug. 20, 1973

[21] Appl. No.: 389,850

[30] Foreign Application Priority Data

Sept. 1, 1972 Japan ..... 47-87631

[52] U.S. Cl. ..... 96/1.4; 96/1 R

[51] Int. Cl.[2] ..... G03G 13/16; G03G 13/22

[58] Field of Search ..... 96/1 R, 1.4, 1 SD

[56] References Cited

UNITED STATES PATENTS

| | | | |
|---|---|---|---|
| 2,756,676 | 7/1956 | Steinhilper | 96/1 R |
| 2,868,642 | 1/1959 | Hayford et al. | 96/1.4 X |
| 2,939,787 | 6/1960 | Gimmo | 96/1 R |
| 3,414,409 | 12/1968 | Gallo | 96/1.4 |

*Primary Examiner*—Roland E. Martin, Jr.
*Attorney, Agent, or Firm*—Wolder & Gross

[57] ABSTRACT

An electrophotographic copy of an original is produced by forming on a transparent photosensitive first substrate a latent electrostatic image of the original by contact exposure, applying a toner powder to the image, superimposing a uniformly charged second substrate onto the image face of the first substrate and exposing the rear face of the first substrate to light to transfer the charged image to the second substrate which is developed to produce a high contrast, high density toner image which is then fused. A machine for practicing the method includes a transparent cylinder which may have a photosensitive face or over which a transparent photosensitive sheet is advanced, is reciprocable over the original with the cylinder rolling over the original, a light source having opposite exposure beam delineating slits is located in the cylinder. A pair of charging devices impart uniform charges of the same polarity the transparent sheet or cylinder which obtains a latent electrostatic image by contact with the original and exposure and is then toned by a rotating developing brush and to a copy sheet which is transported into contact with the cylinder or photosensitive sheet and exposed through its rear to transfer a charged image to the copy sheet. The copy sheet is then exposed to the rotating developing brush to transfer additional toner to the image.

5 Claims, 5 Drawing Figures

ELECTROPHOTOGRAPHIC METHOD OF TRANSFERRING TONER IMAGE

BACKGROUND OF THE INVENTION

The present invention relates to improvements in electrophotographic reproducing machines and methods, and it relates particularly to an improved apparatus and method for forming an electrophotographic image, in which contact reflection printing and a contact transmission printing methods are employed.

The conventional methods for forming an electrophotographic images are the electrofax method and the xerographic method. These methods have been suitably employed only with original documents of high image density and contrast. In such methods, it is impossible to obtain an image which is clearer or better than the original image consequent to the limitations of the developer density and paper tint and accordingly, if the original image to be produced is low in the density and contrast, a poor image is reproduced. In the methods of producing an electrographic image as above described, the optical image projecting system is generally employed, the contact reflection printing system not being practiced, althugh the latter system has many advantages in comparison with the former. Thus, in the reflection printing system no optical projecting system employing lenses and a focussing space are needed, hence the miniaturization of the apparatus is possible, the phenomenon of the synchronous phase-out and the obscure printed image are minimized, and a high speed copying is possible. However, in the contact reflection printing system, the original image is exposed, hence the image reproduced is of extremely low density and contrast, even if an original document bearing an image of a high density and high contrast is used.

Thus, in the conventional method for forming an electrophotographic image, the optical image projecting system is not suitable for copying an original document of low density and low contrast, and the contact reflection printing system is not applicable, even where the original image is of high density and contrast.

SUMMARY OF THE INVENTION

It is a principal object of the present invention to provide an improved method and apparatus for electrophotographic copying.

Another object of the present invention is to provide an improved electrophotographic copying method and apparatus which produces reproductions of high contrast and high density.

Still another object of the present invention is to provide an improved electrophotographic copying method and apparatus employing contact exposure of the original.

A further object of the present invention is to provide an apparatus and method of the above nature characterized by the high quality and superiority of the reproduction, applicability to low contrast, low density originals, the compactness of the apparatus and their great versatility and adaptability.

In a sense the present invention contemplates the provision of a method and apparatus in which a transparent photosensitive substrate is charged and exposed to the image of an original, preferrably by contact, to produce a latent electrostatic image, a toner is applied to the image to produce a separable toner image, a uniformly charged second substrate is superimposed on the image bearing face of the first substrate and the rear of the first substrate is then exposed to light to transfer a charged toned image to the first substrate which is further developed with a toner.

The drawbacks of the conventional methods and apparatus are overcome by the present invention by which there are provided a method for reproducing an electrographic image and the apparatus therefor which are capable of reproducing an original document bearing an image of a low density and low contrast, of using a reflection projecting system; a method for reproducing an image and the apparatus thereof, in which the utilization of a contact reflection printing system is afforded, and a method for forming an electrographic image and the apparatus thereof in which the contact reflection printing system is employed in which there is obtained an image of a high density and high contrast.

BRIEF DESCRIPTION OF THE DRAWINGS

FIG. 3 is an exposed front elevational view of the principal part of an electrophotographic machine embodying the present invention;

DESCRIPTION OF THE PREFERRED EMBODIMENTS

Figure 1:
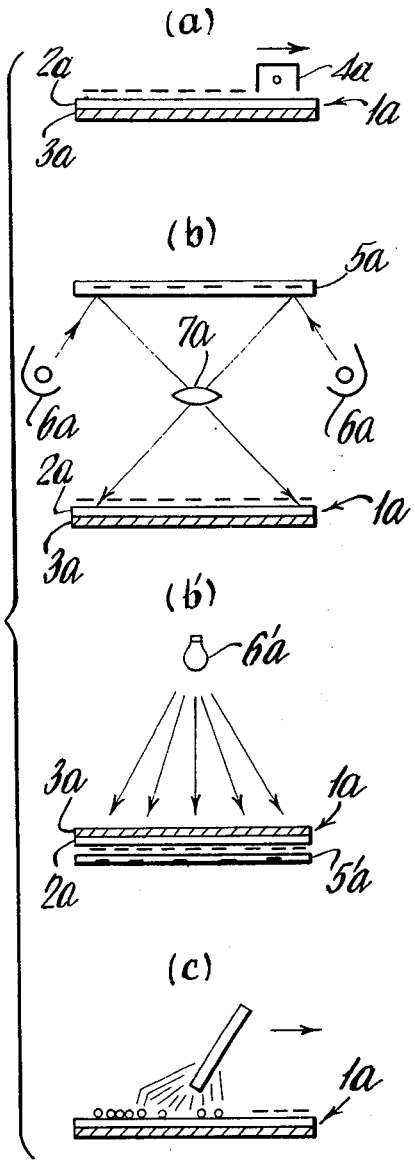
FIG. 1 is a diagrammatic view of the successive steps of the first stage of the method of the present invention.

Referring now to the drawings, FIG. 1 (*a*), (*b*), (*b'*) and (*c*) illustrate known processes for forming a toner image of low density and low contrast on a transparent electrographic sensitive member, FIG. 1 (*b*) showing a process for reproducing an image by the optical image projecting system, and FIG. 1 (*b'*) showing a process for producing an image by a contact reflection printing system.

In FIG. 1, (*a*) illustrates the step of charging, by a conventional charger 4a for example, with a uniform negative charge, a front surface of a transparent electrophotographic sensitive substrate or member 1 having a photoconductive layer 2*a* superposed on a light transparent conductive support member 3*a*. FIG. (*b*) illustrates an original image exposure step, in which an original document 5*a* bearing an image of low density and low contrast is optically projected on the photosensitive member 1 carrying the negative charge, by means of an illumination system 6*a* and projection lenses 7*a*. FIG. (*b'*) illustrates another type of original image exposure step, in which the original document 5'*a* bearing an image of a sufficiently high density and contrast is used and is to be reproduced is positioned in close contact or closely adjacent to the surface of the photosensitive member 1a carrying the negative charge, to thereby effect the contact reflection printing from the back side of photosensitive member 1a by means of the illumination system 6'*a*.

As shown in (*c*), subsequent to step (*b*) or step (*b'*), the original image is developed by a positively charged toner, thereby forming an unfixed separable toner image of low density and low contrast.

Figure 2:
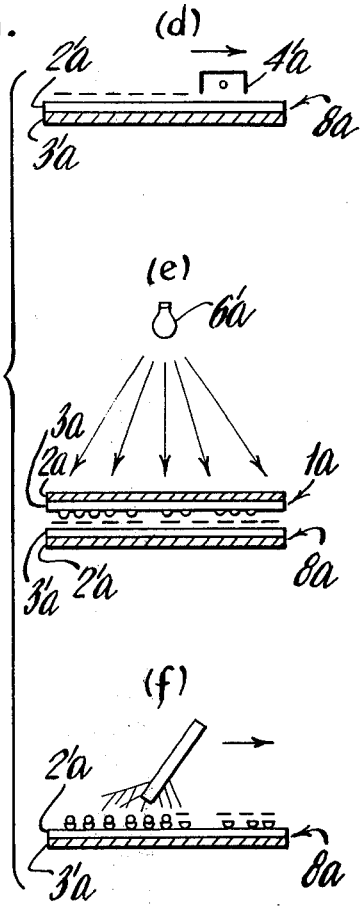
FIG. 2 is a view similar to FIG. 1 of the second stage of the method.

A feature of the present invention resides in the formation of a toner image on another electrophotographic sensitive member, from the toner image obtained in step (*c*). The principle of the image reproducing process which characterizes the present invention is shown in FIG. 2, the steps (*d*), (*e*) and (*f*) in FIG. 2 succeeding step (*c*).

The step (*d*) is a charging step, in which an electrostatic charge of an opposite polarity, e.g. a negative charge, to the polarity of toner on the sensitive member 1 is applied, by a charger 4'a, to a front surface of an electrophotograhic sensitive member or substrate 8 including a photoconductive layer 2'a provided on a conductive support member 3'a. FIG. (*e*) shows a toner image exposure step, in which a sensitive member 8a having a uniform negative charge produced in step (*d*) is disposed in close contact or closely adjacent to the surface of sensitive member 1a bearing the unfixed toner image of positive polarity, for effecting a contact transmission printing by exposing the back side of the photosensitive member 1 to an illumination system 6'a. In this step, the negative charge on the non-toner image bearing area, that is, on the exposure area on the sensitive member 8a, is transferred to the conductive support member 3'a, by the photoconductive layer 2'a becoming light excited, but the negative charge on the toner image overlying area remains. In the meantime, the toner image retaining negative charge on the sensitive member 1a is transferred to the conductive support member 3a since the photoconductive layer 2a becomes light excited and repelled by the strong negative charge on the sensitive member 8a. Consequently, most of the toner on the photosensitive member 1a is transferred to the photosensitive member by the negative charge on the sensitive member 8a.

Thereafter, both photosensitive members are separated from each other, and thus, the negative charge commensurate with the development of the toner image and the transferred toner are obtained on the photosensitive member 8a. On the other hand, adhesion of toner to the surface of sensitive member 1 is minimal and the residue toner, if any, can be removed with ease.

The FIG. (*f*) shows a developing step, in which the sensitive member 8a thus separated from the sensitive member 1a is developed by a toner charged with the positive charge, whereby a toner image of increased density and contrast is formed on the photosensitive member 8a.

According to the present invention, as described in the foregoing, the toner image of a low density and low contrast is converted to a toner image of a greatly increased density and contrast, and besides the aforementioned systems, as in the chargeless system, the photosensitive member itself is effectively applicable in like manner for reproducing an image extremely low in electrostatic contrast. These permit the achievement of various methods for reproducing an electrophotographic image which have not been in practical use because of the insufficiency in the image density. As will be apparent from the toner image exposure process described in the process (*e*) residual toner on the sensitive member 1 is easily removable therefrom, and this permits the repetitive use of the sensitive member.

Figure 4:
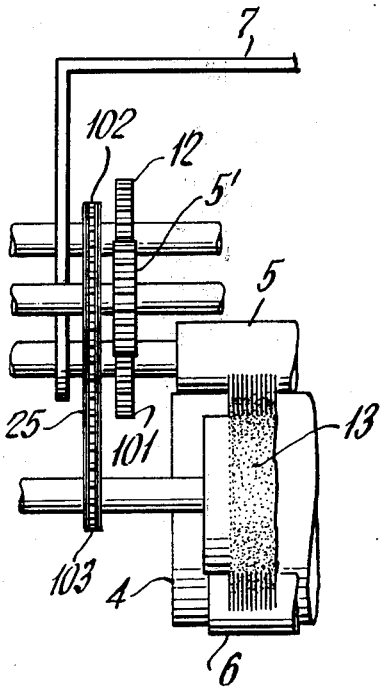
FIG. 4 is a fragmentary end elevational view of a part thereof.
Figure 5:
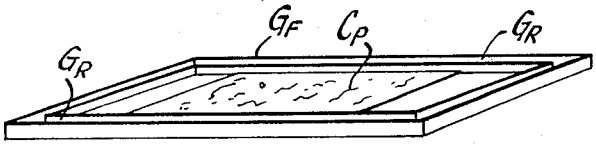
FIG. 5 is a perspective view of an original support and guide frame employed in the machine of FIG. 3.
Figure 2:
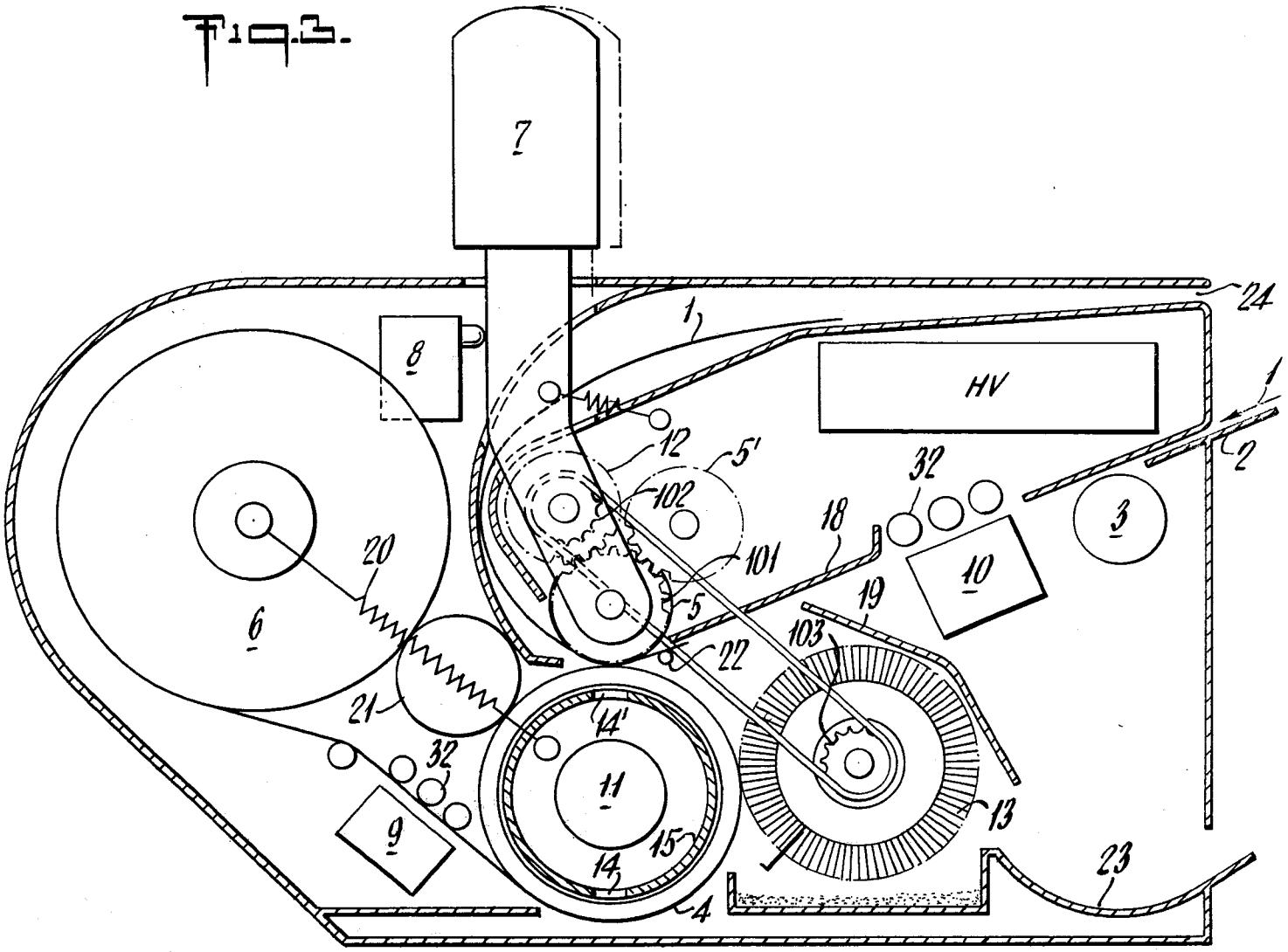

Referring now to FIGS. 3 to 5 of the drawings which illustrate a preferred embodiment of the present invention, the reference numeral 1 generally designates a photosensitive paper and 2 designates a slot for feeding the photosensitive paper 1 through the copier housing to a roller 3 for transferring the photosensitive paper 1. A rotatable transparent cylinder 4 is engaged by a parallel contact roller 5 and a gear 5' meshes with a gear section on the contact roller 5. A light transparent photosensitive member 6 consists of, for example, a roll of paper or film, and a handle lever 7 interconnected with the contact roller 5 serves to switch the operations of the electrostatic reproducing machine, and a microswitch is actuatable by the handle lever 7.

First and second chargers 9 and 10 are provided for applying electrostatic charges to the light transparent photosensitive member and the photosensitive paper, and a light source 11 is disposed within the cylinder 4. A gear 12 is adapted to mesh with either the gear section 101 of contact roller 5 or the gear 5' according to the switching operation of the handle lever 7. Disposed proximate cylinder 4 is a developing brush 14. Opposite longitudinal exposure slits 14 and 14' are provided in a stationary cylinder 15 disposed within the transparent cylinder 4. Reference numerals 18 and 19 designate paper guide plates, 20 a spring, 21 a roller, 22 a pin, 23 a copy carrying sensitive paper receiving plate, 24 a photosensitive member discharge slot, and 32 electrodes grounded for facilitating the uniform charge and the smooth transfer of the photosensitive paper. A sprocket chain 25 couples a sprocket wheel rotatable with gear 12 and developing brush 13 to effect the rotation of brush 13 with the reciprocal movement of the machine. A high voltage supply HV of the known type consisting of a suitable source of DC potential such as a piezoelectric element and or an oscillation circuit and rectifier is associated with chargers 9 and 10 and at Or an original document being reproduced is shown. The photosensitive paper may be either transparent or opaque. The fixer is provided as a separate unit.

As seen in FIG. 4, sprockets 102 and 103 respectively are provided on the shaft of gear 12 and the developing brush 13 and are coupled by a chain 25. 101 is a gear mounted on the same shaft as the roller 5 and is always meshed with the gear 12. 5' is another gear meshed with the gear 101 by means of a spring and movable into engagement with the gear 12 in the return movement of the machine proper, as will be explained more fully later.

In operating the electrostatic reproducing machine described above, first a roll of light transparent, flexible photosensitive member or substrate 6 is manipulated to extend the leading end thereof around the lower face of cylinder 4 to the bite or contact portion between the transparent cylinder 4 and the contact roller 5, and then the leading end is transferred to the discharge slot 24 by idly rotating the transparent cylinder 4.

This setting of the leading end of the light transparent photosensitive member to the bite is accomplished, for example, by providing a side frame (not shown) on the machine proper that is operable as a door and thereby with this side frame opened the leading end of the light transparent photosensitive member can be set in the contact portion manually with ease.

Subsequently the photosensitive paper sheet 1 of a given length is fed into the machine through the slot 2, and the paper transfer roller 3 is rotated to a position indicated by any suitable means controllable from the outside of the machine, for example, by a dial, so as to position the leading end of sensitive paper 1 to engage the bite between the contact roller 5 and the transparent cylinder 4.

In the meantime, an original document guide frame $G_F$, as shown in FIG. 5, is preset on the base portion of machine proper. The guide frame $G_F$ is provided with a pair of channel guide rails $G_R$ on both sides relative to the moving direction of the machine proper. The pair of guide rails $G_R$ receive therein side plates (not shown) of the machine proper, such that when the cylinder 4 is rotated, the rotation of the cylinder serves as a motive power and causes the movement of the machine proper along the pair of guide rails $G_R$ on the original document guide frame $G_F$. In FIG. 5, designated at Cp is a copying portion. The length of the photosensitive paper 1 is determined depending upon that of the original document guide frame $G_F$.

In setting the machine on the original document being reproduced, the original document Or is set in place so as to coincide with the copying portion Cp of original document guide frame $G_F$ connected to the machine proper, and then transfer the handle lever 7 to the position shown by the solid line from the position shown in dotted line in the drawing. The movement of the handle lever 7 actuates the micro-switch 8, whereby the charging devices 9 and 10 and the light source 11 are actuated to an operative state. Upon further movement of the handle lever 7, the transparent cylinder 4 in contacting relation with the original documentn is caused to rotate in a counter-clockwise direction, and this causes the movement of the machine proper in the direction of arrow A, to the left as viewed in FIG. 3.

In order to form an electrostatic latent image in conformity with the original document by contact with the transparent sensitive member 6 which is uniformly charged with a specific polarity by the charging device 9, the sensitive paper 6 is exposed through the lower exposure slit 14 of the stationary cylinder 15 disposed within the transparent cylinder 4. Thus, an electrostatic latent image is formed, after which the latent image is developed by the toner carrying rotating developing brush 13 into an electrostatic powder image. The developing brush 13 is rotated in a reverse direction with respect to the travelling direction of the light transparent photosensitive member 6, so as to ensure the sufficient distribution of the developer or toner over the sensitive paper, and the rotation thereof is produced by the rotation of the gear 12 connected thereto by way of a chain 25. The rotation of gear 12 is produced from the transparent cylinder 4 through the contact roller 5. Meanwhile, the photosensitive paper 1 is uniformly charged to the same polarity as photosensitive member 6 by the charging device 10 and is transferred in close contact with the light transparent photosensitive member 6 with the rotation of the transparent cylinder 4. The photosensitive paper 1 is exposed to light through the upper slit 14' at the contact portion between the transparent cylinder 4 and the contact roller 5, and is thus subjected to the contact transmission printing, whereby the powder image carried by the light transparent photosensitive member 6 is transferred to the photosensitive paper 1 and defines an electrostatic latent image. For facilitating the aforementioned operations, it is preferable to set the machine so as to position the lower slit 14 within the cylinder 4 at the trailing side of the copying portion Cp of the guide frame $G_F$, and the distance from the leading end of photosensitive paper 1 to the rear end of charging device 10 is preferrably equal to the distance from the contact portion between the cylinder 4 and the contact roller 5 to the rear end of the charging device 9.

When the trailing end of photosensitive paper 1 is advanced to the side of the separation pin 22, the movement of the machine in the direction of arrow A is completed. At this stage, the used light transparent photosensitive member 6 which has been delivered through the discharge slot 24 is separated. Then, the handle lever 7 is returned to its retracted position as shown by broken line to transfer the micro-switch 8 to the off-position. By further movement of the handle lever 7, the transparent cylinder 4 is caused to rotate in the reverse direction, namely, in the clockwise direction. When the handle lever 7 is fully retracted, the gear 12 as brought into engagement with the gear 5' in meshing relation with the gear section 101 of the contact roller 5. At this point, the space between the sprockets 102 and 103 is unchanged. The rotation of the contact roller 5 in the counter-clockwise direction causes the gear 5' to rotate in the clockwise direction, while at the same time causing the gear 12 to rotate in the counter-clockwise direction, whereby the developing brush 13 rotates in only one direction.

With the rotation of the transparent cylinder 4 in the reverse direction, the machine returns to its initial position, and synchronously with the return movement of the machine proper, both the light transparent photosensitive member 6 and the photosensitive paper 1 are retracted, whereby the light transparent photosensitive member 6 is taken up or rewound into a rolled state, while the photosensitive paper 1 is separated and led by the pin 22 from the member 6 to travel along the under side of guide plate 19, during which period the sensitive copy paper 1 is developed by the developing brush 13, thereby forming an image of strong contrast. As soon as the photosensitive paper 1 is delivered to the receiving plate 23, the rotation of the transparent cylinder 4 is stopped. Thus, the machine is reset to its initial condition. After the machine proper is restored to the initial position, the transparent cylinder 4 is again idly rotated to transfer the leading end of light transparent photosensitive member 6 to the discharge slot 24, then the reproducing operation may be repeated in the above manner. In this case, the light transparent photosensitive member 6 once used in the preceding copying operation is discarded. The spring 20 connected between the cylinder 4 and the central portion of the roll of light transparent photosensitive member 6 serves to pressure-contact the roller 21 between the transparent cylinder 4 and the light transparent photosensitive member 6, to thereby prevent the transparent sensitive member 6 from being loosened.

In the embodiment aforementioned, the ight transparent photosensitive member 6 is arranged for a single use. Where a repetitively serviceable roll of light transparent photosensitive member is used as a sensitive member, an arrangement required in the commencement of copying operation for inserting the leading ends of both light transparent photosensitive member 6 and photosensitive paper 1 together into the bite between the cylinder 4 and the contact roller 5. In order to repetitively use the light transparent photosensitive member 6, the cleaning of the used photosensitive member is imperative, and the cleaning is effected, using the developing brush provided for developing the sensitive paper. Thus, in the contact transmission printing process subsequent to the formation of the electrostatic powder image, the powder image bearing photosensitive member is brought into close contact with the photosensitive paper which has been uniformly charged in the preceding step, so as to be exposed to light from the back side thereof, whereupon the charge on the exposed area of the photosensitive paper, viz. on the non-toner image bearing area, is discharged by light excitation and consequently the powder image on the photosensitive member is transferred by the charge onto the photosensitive paper. At the same time, the charge which has retained the powder image is attenuated by the exposure. Accordingly, the exposure in this case serves as a discharger for the photosensitive member. In addition, the major part of toner adhered to the developing brush is adhered to the surface of photosensitive paper, such that no significant residual toner is adhered to the light transparent photosensitive member, and the developing brush is in turn operated to remove the residual powder image remaining on the photosensitive member. Furthermore, the developing brush is arranged to rotate in the same direction to the travelling direction of the photosensitive member when the machine proper is restored to its initial position and to rotate in the opposite direction to the travelling direction of the photosensitive paper. This facilitates the adhesion of the toner to the photosensitive paper, with no adhesion to the light transparent photosensitive member.

If a repetitively serviceable light transparent photosensitive member is to be further achieved, the transparent cylinder may be replaced by a transparent electrophotographic sensitive cylinder, such that the light transparent electrophotographic sensitive cylinder serves as a photosensitive member as described in the aformentioned embodiment, in which case the developing brush serves both as developing means and as cleaning means.

As is apparent from the foregoing description, the electrostatic reproducing machine according to this invention is so arranged that the frictional rotation betwen the transparent cylinder and the original document is used as a driving source for the machine, and the transfer of the transparent sensitive member and the photosensitive paper, the rotation of developing brush and the control of other means are achieved by the frictional connection or interconnection with the transparent cylinder. These serve to achieve the simplification in the mechanical construction and the miniaturization of the machine itself. Referring to the reciprocating movement of the machine proper, it is noted that in the initial advancing motion, an image is formed by the contact reflection printing and the image thus formed is transferred by the contact transmission printing, while in the returning motion of the machine proper, the latent image is developed. Where the repetitively usable photosensitive member is used, either the developing or the cleaning is effected during that returning movement. Also, it is to be noted that the charging devices and the light source are arranged to be operative only when the machine proper is in the advancing motion, for improving efficiency.

While there have been described and illustrated preferred embodiment of the present invention, it is apparent that numerous alterations, omissions and additions may be made without departing from the spirit thereof.

I claim:

1. An electrophotographic copying method comprising the steps of producing a latent electrostatic image of an original on a front surface of a light transmitting first photo-conductive substrate, applying a toner to said image to form a separable toner image, applying an electrical charge of the polarity of said latent image to a front surface of a second photo-conductive substrate, bringing said front surfaces of said first and second substrates into close confrontation and exposing the rear surface of said first substrate to light to form an electrostatic latent image corresponding to said toner image on said second substrate and simultaneously transferring said toner image thereonto, separating said substrates and applying a toner to said toner image bearing surface of said second substrate.

2. The method of claim 1 wherein the step of producing said latent electrostatic image on said first substrate comprises the steps of applying an electrical charge to said first front face, positioning said electrically charged first substrate front face in close confrontation with an original and exposing the rear surface of said first substrate to light.

3. An electrophotographic copying method comprising the steps of forming an electrostatic latent image corresponding to an image of an original on a light transparent photoconductive member, developing said latent image with toner having a polarity opposite to said latent image to form a toner image, uniformly applying an electrical charge to another photoconductive member with the polarity opposite to that of toner, contacting the both surfaces of said members with the toner image surface and the uniformly charged surface confronting each other and exposing the rear surface of said light transparent photoconductive member to form an electrostatic latent image corresponding to said toner image and simultaneously transferring said developed image onto the surface of said other photoconductive member, separating the both members, and developing said other photoconductive member with toner to form thereon a final toner image of said original.

4. The method of claim 3 comprising the step of fixing the final toner image.

5. The method for obtaining a high contrast reproduction image comprising the steps of:

a. applying a electrical charge on a front face of a light transparent photoconductive member;
b. positioning said electrically charged front face in close confrontation with an original;
c. exposing the rear surface of said light transparent photoconductive member to form an electrostatic latent image of said original on the front face of said image of said original on the front face of said photoconductive member;
d. developing said electrostatic latent image with toner having a polarity opposite to that of said latent image;
e. applying an electrical charge of the polarity opposite to that of said toner on a front face of another photoconductive member;
f. positioning the front faces of said photoconductive members in close confrontation with each other;
g. exposing the rear face of said light transparent photoconductive member to form an electrostatic latent image corresponding to said toner image on said other photoconductive member and simultaneously transferring said toner image thereonto;
h. separating said photoconductive members; and
i. developing said other photoconductive member formed with the transferred toner image and the electrostatic latent image corresponding thereto with toner.

* * * * *